US005809989A

United States Patent [19]

Nelson

[11] Patent Number: 5,809,989

[45] Date of Patent: Sep. 22, 1998

[54] APPARATUS AND METHOD TO PREVENT CAMPFIRES FROM SPREADING

[75] Inventor: Michael J. Nelson, Livermore, Colo.

[73] Assignee: Dacotah Rose, Inc.

[21] Appl. No.: 608,576

[22] Filed: Feb. 28, 1996

[51] Int. Cl.[6] ..... F24B 1/192

[52] U.S. Cl. ..... 126/544; 126/9 R; 126/29; 126/25 R; 126/519; 126/500; 135/100; 135/147; 135/143

[58] Field of Search ..... 126/201, 9 R, 126/9 B, 29, 30, 214 D, 218, 27, 25 R, 500, 505, 507, 519, 544, 548, 551; 110/119, 125, 241, 145; 160/352, 354, DIG. 9; 55/DIG. 20, DIG. 30, DIG. 31; 135/97, 115, 100, 143; 47/26, 28.1, 29, 31; 34/239

[56] References Cited

U.S. PATENT DOCUMENTS

| | | | |
|---|---|---|---|
| 99,801 | 2/1870 | Willard . | |
| 202,914 | 4/1878 | Wyman . | |
| 281,766 | 7/1883 | Howling . | |
| 509,892 | 12/1893 | Gray . | |
| 544,629 | 8/1895 | Phillips . | |
| 614,932 | 11/1898 | Carper . | |
| 796,751 | 8/1905 | Nimmo . | |
| 805,814 | 11/1905 | Palmer . | |
| 989,417 | 4/1911 | Raggio . | |
| 1,058,142 | 4/1913 | Bernitt . | |
| 1,171,005 | 2/1916 | Stoddard . | |
| 1,192,315 | 7/1916 | Hughes . | |
| 1,279,033 | 9/1918 | Stollberg . | |
| 1,372,424 | 3/1921 | Haase . | |
| 1,392,178 | 9/1921 | Kuebler | 47/29 |
| 1,499,665 | 7/1924 | Kaufman . | |
| 1,651,818 | 12/1927 | Gorrell | 126/30 X |
| 1,751,807 | 3/1930 | Ford . | |
| 1,871,571 | 8/1932 | Weber . | |
| 2,001,360 | 5/1935 | Heuston . | |
| 2,424,665 | 7/1947 | Pope | 126/9 |
| 2,466,496 | 4/1949 | Smith | 135/1 |
| 2,469,885 | 5/1949 | Molla | 126/144.9 |
| 2,525,683 | 10/1950 | Keely | 160/84 |
| 2,570,508 | 10/1951 | Balkema | 126/9 |
| 2,577,667 | 12/1951 | Waite | 160/352 |
| 2,595,833 | 5/1952 | Flaherty | 160/369 |
| 2,718,278 | 9/1955 | Sargent | 183/51 |
| 2,743,660 | 5/1956 | Scherff | 98/103 |
| 2,743,686 | 5/1956 | Samuelson | 110/19 |
| 2,887,154 | 5/1959 | Morningstar et al. | 160/351 |
| 3,120,076 | 2/1964 | Zuch | 47/31 |
| 3,316,892 | 5/1967 | Hanke | 126/25 |
| 3,384,066 | 5/1968 | Tufts | 126/9 |
| 3,851,639 | 12/1974 | Beddoe | 126/25 |
| 4,467,781 | 8/1984 | Campbell | 126/201 |
| 4,651,706 | 3/1987 | Groeneweg | 126/30 |

FOREIGN PATENT DOCUMENTS

| | | |
|---|---|---|
| 8783 | of 1905 | United Kingdom . |
| 312820 | 6/1928 | United Kingdom . |
| 365861 | 3/1931 | United Kingdom . |
| 708579 | 5/1954 | United Kingdom . |
| 1147237 | 4/1969 | United Kingdom . |

OTHER PUBLICATIONS

*Northern* Catalog, 1994, p. 101, Outdoor Fireplace/Fire Pit.
*Official Gazette*, 1897, p. 1538, Plumber's Furnace.
*Rocky Mountain News*, 1994, *Made in Colorado* by David Lewis, article on fire pit.

*Primary Examiner*—Carl D. Price
*Attorney, Agent, or Firm*—Santangelo Law Offices, P.C.

[57] ABSTRACT

The devices and methods described relate to the prevention of the spreading of campfires which might create forest fires through the unintentional emission of embers and sparks. The invention encloses the campfire in a three dimensional space. It is self-supporting, is easily portable and transportable by selection of an appropriate shape and weight, and is compactable through folding or rolling by the use of rings or hinges. The principal geometric shape is pyramidal with the use of multiple panels. Further, these panels have two end panels which can be folded out to allow temporary access to the campfire.

28 Claims, 6 Drawing Sheets

APPARATUS AND METHOD TO PREVENT CAMPFIRES FROM SPREADING

I. BACKGROUND

This invention relates to an apparatus and methods which enhance the safety and enjoyment of a campfire. In particular, it relates to surrounding a campfire with a self-supporting, portable and transportable, compactable, pyramid-shaped, fire-preventing device. The method is directed to the portable and compactable devices. Central is the provision for allowing flames to pass outside of a specified boundary while preventing ember and other such potentially dangerous materials from passing through the surface. This is of fundamental importance because a substantial number of forest fires and a substantial amount of damage is caused through careless use for inattention to campfires. The significance of the present invention is particularly noticeable when one considers the fact that it has long been recognized that campfires, although constituting a substantial aspect of forest fire danger, present an aspect which is difficult to manage. The "Only You Can Prevent Forest Fires" campaign typifies the approach taken for decades prior to the present invention. This approach focused on the individuals' attitudes toward responsible use—rather than their use itself. This long felt, but unsatisfied need to control the use of a campfire itself has existed even while the implementing arts and elements have been readily available. The fact that these arts and elements have not heretofore been combined and selected in the combinations presented demonstrates that those skilled in the art had not considered approaching the problem from the perspective of managing the campfire itself rather that the user's attitudes. Prior to the present invention, attempts to address the danger of forest fires were approached through macroscopic management techniques, including provision for campsites and permits rather than the management of individual fires. In fact, other than addressing general safety precaution, prior efforts to manage the danger of forest fires have actually been directed away from microscopic management of the fire itself. These prior efforts could lead one to believe that those involved assumed microscopic management to be too difficult or perhaps impossible. They indicate that those in the particular field of forest fire management simply failed to understand that the management of the fire itself was not only possible, but was also an important aspect of the general problem of reducing forest fires.

The fact that a microscopic approach to campfire management has not been pursued is demonstrated by the fact that virtually no prior inventions are directed to this particular field as described here. For instance, U.S. Pat. No. 4,651,708 to Groeneweg for a Portable Campfire and Grill demonstrates through both its recency and its very subject matter that the focus of inventions relating to campfires has ignored the consideration of forest fire safety and has failed to recognize the fact that true portability is a critical factor. This latter aspect is critical because the more remote an area the more severe the danger posed by forest fires. Although the Groeneweg invention does include as part of its objects containing the campfire and protecting the ground immediately adjacent to the campfire, it does not provide for the total containment of embers and other such dangers completely around the fire itself Particularly limiting in relation to the field of the present invention is the fact that the Groeneweg invention is not easily transported to remote areas by virtue of its weight and size.

Another example, U.S. Pat. No. 2,466,496 to Smith for a Portable Outdoor Cooker, demonstrates that some thought was given to keeping insects out of outdoor cooking pots, but does not even mention retaining the embers of a fire. It appears to have not been an issue to the Smith disclosure. The Smith invention also failed to appreciate the portability and foldability issues. The Smith invention has only three sides. A three panel apparatus would necessarily have a relatively long base length for each panel. It would be difficult to pack such a long base length, for instance, in a backpack for remote areas. Yet, remote areas are where the need might be the greatest, where fire fighters would have difficulty responding to a campfire-created forest fire. The present invention overcomes this difficulty, in respect to at least the portable embodiments, by restricting the base length of each panel to a suitable size and yet still surround the campfire. Smith also requires a frame separate from the panels. This complicates the device for portability. The present invention, in at least one portable embodiment, has self-supporting members, not requiring a separate frame.

In U.S. Pat. No. 3,851,639 to Beddoe for a Portable Combination Cooking Apparatus and Method, the invention relates to portable outdoor cooking units. Again, the focus is not on enhancing the safety of campfires—rather it was on providing a multi-purpose cooking unit. Rather than focusing on the safety of campfires, the Beddoe invention was designed to solve the problem of controlled combustion for cooking purposes. The invention also is not portable to the degree necessary to effectively address the forest fire problem. Similarly, U.S. Pat. No. 2,424,665 to Pope for a Collapsible Cooking Stove was designed for the needs of a multi-purpose cooking unit rather than the safety of campfires. The Heating Stove of U.S. Pat. No. 99,801 to Willard was designed to burn tree stumps by the use of sheet iron and did not have in mind the portability and configuration necessary for remote use on a campfire.

U.S. Pat. No. 4,467,781 to Campbell for a safety apparatus for portable fuel-burning heaters relates to the very different field, namely indoor fuel-burning heaters. This field is vastly different from the field of the present invention. Not only is the Campbell invention directed to the entirely different problem of burns or injuries from contact with the heater itself, it also is not designed with portability in mind, let alone the degree of portability necessary to the present invention.

Finally, as background to the present invention there exists inventions in other, unrelated fields such as incerators, trash burners, and welding shielding. For instance, U.S. Pat. No. 2,718,278 to Sargent is for a spark arrestor for the top of chimneys. It appears to be made of heavy structure in four pieces, taken to the jobsite, and sealed in place with cement after assembly. It is not portable in the sense of being transportable from place to place. It does not even surround a fire and certainly is not made for a campfire. Examples of incinerators are U.S. Pat. No. 1,651,818 to Gorrell for a collapsible incinerator and U.S. Pat. No. 2,743,686 to Samuelson for a combination trash receptacle and burner unit. Neither device was designed for campfires and especially remote campfires. In Patent No. 708,8579 to Price in Great Britain for an improved fire guard or screen, the device is a rectangular, three sided, open back fireplace cover with a top that can be raised vertically. It is made for hearths and facings of typical domestic fireplaces, not campfires. Each of these fields are quite different from the field of the present invention. Inventions in these areas are designed to solve vastly different purposes and problems.

Interestingly, despite the widespread use of screen and despite the widespread use of campfires and the need to prevent forest fires, no one, to the applicant's knowledge has ever brought all the elements together as a unit. It appears to simply not have occurred to combine the elements in the unique fashion necessary to produce the claimed invention.

II. SUMMARY OF THE INVENTION

In view of the scarcity of prior inventions in the relevant field, the general objects of the present invention are to broadly provide a means to reduce the danger of forest fires and to enhance the safety of campfires. An important object of this goal is to provide a device which may be easily transported even to remote sites.

Another general goal of the invention is to provide a means whereby a campfire may be surrounded in a three dimensional space, in one hemisphere, by a surface through which flames may pass, but through which embers, sparks, and other such potentially dangerous items may not pass.

An object of embodiments of the present invention is to allow an easily compactable device for the prevention of forest fires. A further object of some of the embodiments of the invention is to provide for compactability by designing an apparatus which may be folded or which may be rolled.

Still another object of embodiments of the present invention is to provide for ease of transportability by providing for a container or cover in which the apparatus may be transported or stored.

Another object of embodiments of the invention is to cover a campfire in a three dimensional space by a surface which can be easily lifted for access to the fire itself.

Several embodiments of the present invention also have as objects providing for a supported horizontal surface directly above the campfire.

Still another object of the invention which may be incorporated into any embodiment is providing a device for the safety of campfires which also allows for ease of use by means of handles and hinges to allow access to the fire. Another object of the invention which may be incorporated into any embodiment is to provide for a means to easily contain or dispose of the ashes or other remainder from a campfire after use.

Another object of the invention is to provide for a device to enhance the safety of the campfire which may be permanently mounted to a stone or fixed base. A practical object of the invention is to provide for a product which may be easily manufactured with a minimum of materials.

Another object of the invention is to provide methods of enhancing the safety of a campfire by obtaining the necessary material and assembling and using the assembly around a properly prepared campsite location. The steps of the methods can be done in any logical order and at any suitable time independent of each other.

Naturally, many other objects of the invention exist as are described herein.

III. BRIEF DESCRIPTION OF THE DRAWINGS

FIG. 1 is a perspective view of the pyramid-shaped device in the assembled position.

FIG. 1*a* is a top view diagram, illustrating the arc angle $\alpha$ for a panel and the distance d from a chord to the radius R of a panel formed in an arc.

FIG. 2 is a side view of the portion of the foldable device with an integral frame and with ring methods for folding including some grommets.

FIG. 2*a* is a side view portion showing material folded over to create a stiffened edge and includes grommets in which the rings are inserted.

FIG. 2*b* shows an upper end of an assembly of panels converging to a vertex with a vertex ember restrictor mounted over the assembly.

IV. DETAILED DESCRIPTION OF THE PREFERRED EMBODIMENTS

Figure 1:
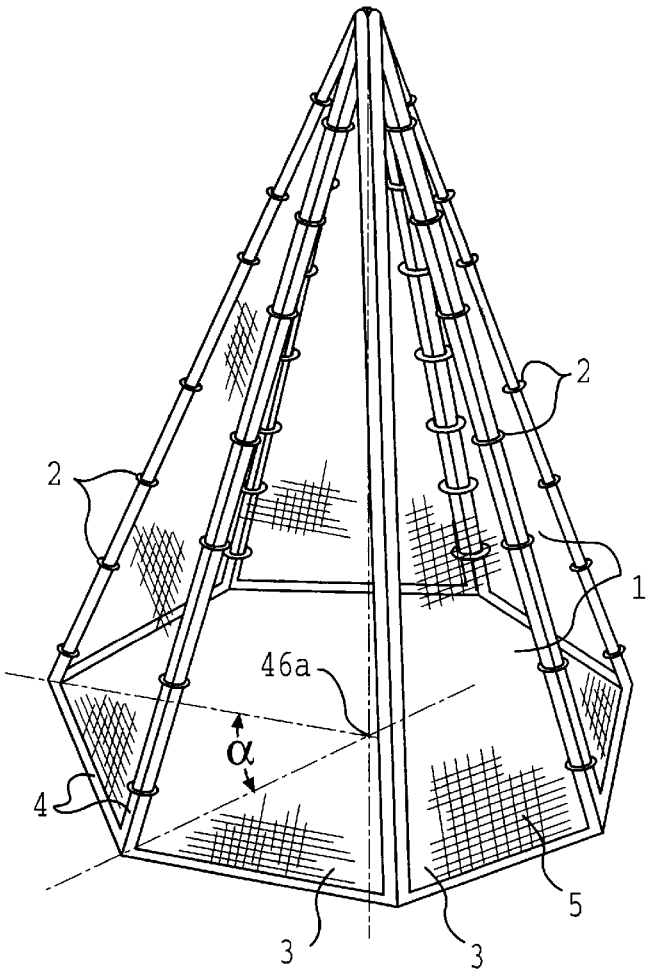

With reference to the drawings, the preferred embodiments of the present invention are as follows:

In a general sense the present invention may have many different geometric shapes. Referring to FIG. 1, a perspective view of the pyramid-shaped device, one embodiment incorporates numerous (at least three) triangularly-shaped side panels (1) which are joined together by some hinge elements. These panels (1) can be self-supporting. In FIG. 1, the hinge elements may be a series of rings (2) which join the sides of the triangularly-shaped side panels (1). The hinge elements can also be creases in a suitable material, hinges, or anything suitable for folding back and forth. As can be readily understood from FIG. 1, the triangularly-shaped side panels (1) are serially joined together such that two of the panels are end panels (3). In the embodiment shown, the end panels (3) abut and are maintained against each other by the placement of the entire device on a flat surface.

The size of the device can be expanded by adding extra panels (1) to the assembled device, even after purchase. These additional panels can be hingeably attached through rings, hinges, creased structural material, and so forth in a similar fashion as the original panels of the device. Different sizes can be made such as small ones for backpacking, larger ones for family picnicing, or other suitable sizes.

Figure 2:
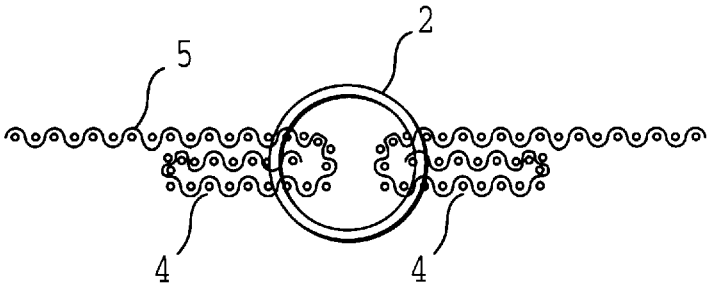

Each of the triangularly-shaped panels (1) can include a frame member (4) which adds structural rigidity along the edges of each panel. Referring now to FIG. 2, a side view of the portion of the foldable device, it can be seen that the frame member (4) may be formed by merely folding the edges of the particular material involved. The material is folded over itself twice (but could be more or less depending on the support needed) to combine a need for simplicity of construction with the structural requirements presented. Naturally numerous ways of folding or bending the materials used could be accomplished. A ring (2) is then shown placed through these folded portions. The ring (2) when placed at several locations allows the panels to be easily folded. The material utilized to form the surface of the device is preferably some type of screen (5). This screen (5) may be made from a material which not only provides the desired rigidity but also is fire resistant or fireproof and may be light weight. An example of one material which may be used is 24—24 mesh, 0.020 wire diameter steel screen as is available from many sources in the industry. This screen has the properties of first having a sufficiently fine mesh to adequately trap most of the embers and sparks from the fire; it also is resistant to degradation from exposure to heat and flame as is inherent in this application. Additionally, stainless steel material could be used. This stainless steel mesh has the additional property of resisting oxidation or rusting and thus enhancing the longevity of the product.

Figure 2A:
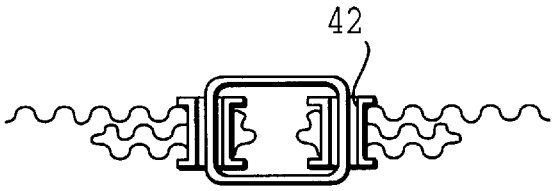

Similarly, as shown in FIG. 2*a*, the frame member (4) may contain a plurality of ring hinge receptors (42) placed in the edges. The receptors (42) assist in retaining the folded material and allow easier and more durable folding of the panels (1) when inserting the ring (2) through the ring hinge receptors (42). These receptors can be grommets or similar items.

As may be appreciated, the frame member (4) may also be formed from separate members. Similar properties from the material used for such separate frame members are also desirable. Because flames do not need to pass through these members, such material might be an aluminum or other structurally sufficient yet lightweight product. Naturally, it would be desirable for the rings (2) to have similar properties. However, due to the size of the rings, their material is less critical because they appear less susceptible to either wear or the aforementioned decay.

In utilizing the device shown in FIG. 1, the screen is assembled around the fire to as to form a polyhedron. The fire would be located at the base of the polyhedron approximately under its vertex at the center point (46*a*). This polyhedron, shown in FIG. 1 as having eight sides (although the number could be less or more, depending on the size of the fire and other requirements) surrounds the fire in a three dimensional space above the ground. Each panel would occupy an angle $\alpha$ which generally would be equal to the number of panels divided into a 360° circle. For instance, with eight panels, the angle $\alpha$ would have a value of 45°. More or less panels would necessarily change angle $\alpha$. Furthermore, this angle is not meant to be an exact measurement as the angle may change depending on any gap occurring between the panels as assembled, the number of panels as discussed, and so forth.

By this process, the device is able to restrict the majority of embers or sparks which are emitted from the fire. These embers or sparks would encounter the screen and thus would fall back into the fire rather than being allowed to be blown to other locations. As can be readily understood, folding of one or both of the end panels (3) back over the adjacent triangularly-shaped side panel (1) allows access to the fire. After such access the bases of the end panels are folded back to approximately meet and again surround the fire in one hemisphere. As shown, the polyhedron has for its base a polygon and for faces triangles with a common vertex. Naturally any number of faces could be used so long as the device presents a sufficient volume in which the burning materials will be wholly contained and of sufficient width so as to be stable.

Figure 1A:
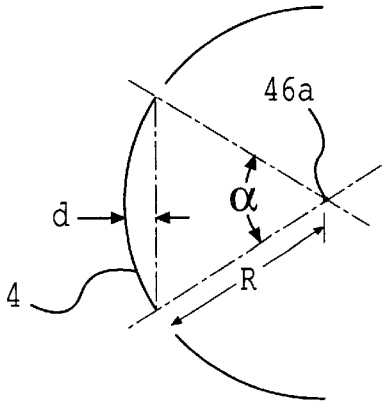

In FIG. 1*a*, the panels are bent to form an arc. If d represents the distance between a radius R from the center point (44) and a chord drawn between the two ends of each panel, the value of d would be equal to R $(1-\cos \frac{1}{2}\alpha)$. This extension by a distance d would add further volume to the device assembled around a campfire compared to the embodiment shown in FIG. 1. Further, when so designed, each panel (1) would present a segmented fragment of a conically shaped surface and so, when assembled, would form a more conically shaped product.

Figure 2B:
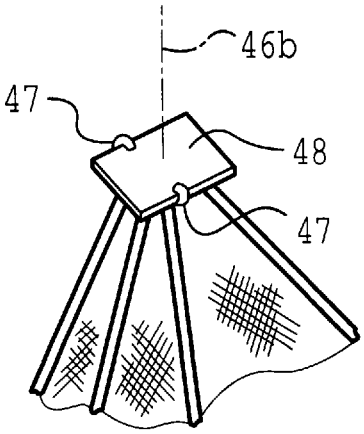

Ideally, the panels assembled in position would converge at the vertex (46*b*) with no gap at the top of the panels. Unfortunately, this does not happen, leaving a gap for sparks and embers energized by the campfire to flow upwardly through the gap in the vertex. An alternative embodiment is shown in FIG. 2*b* where a vertex ember restrictor (48) is shown. This restrictor can be of the same material as the panels or can be solid, or in a variety of configurations. However, important to its function is that it be maintained over the gap in the vertex. The restrictor can be sized to overlap the gap. One embodiment to assist in this maintenance of the position of the restrictor is to attach it to the upper end of at least one panel and preferably two panels. If the panels are viewed in an assembled condition substantially surrounding the campfire, the upper end of each panel (1) would be facing an opposite panel. By hingeably attaching with attachments the overlapping vertex restrictor (48) across from panels on one side to opposite panels on the other side at the upper end, i.e. substantially diametrically opposed panels, the restrictor (48) substantially maintains its position above the vertex was assembled.

Perhaps one of the most important advantages of the present invention is not only its ability to prevent embers or other sparks from passing outside the screen (5) but also the fact that the screen allows the flames to pass outside the surface unhindered. This permits aesthetic enjoyment of the fire. Combining these two objects requires that the screen (5) chosen for the device have a mesh sufficiently large to allow flames to pass outside the surface and yet have a mesh sufficiently small to restrict most (if not all) embers from passing outside the surface. The material mentioned earlier appears to present an appropriate balance between these two tendencies.

Figure 3:
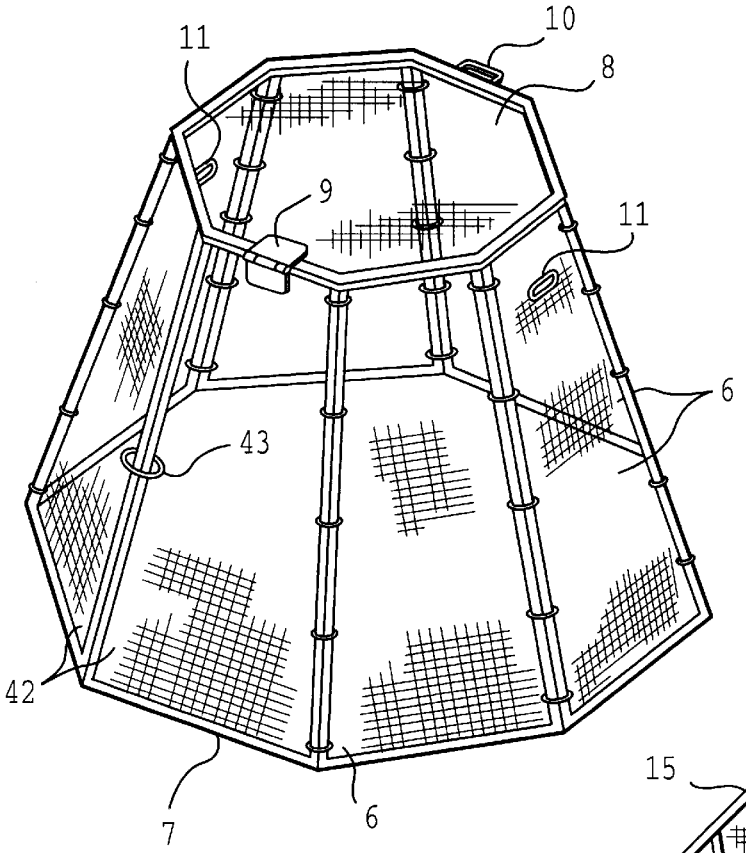
FIG. 3 is a perspective view of the truncated pyramid-shaped device having a horizontal top surface.

Referring now to FIG. 3, the truncated pyramid-shaped device, one can see that alternative embodiments are possible to address any desire for additional structural rigidity, and transportability As in the device shown in FIG. 1, the truncated device shown in FIG. 3 includes side panels which are truncated side panels (6). These truncated side panels (6) may also be serially connected together as described for the embodiment shown in FIG. 1. If so connected, there will be two truncated end panels (42). The edge of the truncated side panels (6) opposite the base (7) is then adjacent to a top surface (8). This top surface (8) may be attached to one of the truncated side panels (6) by means of a top hinge (9). This top hinge (9) permits lifting of the top surface (8) by means of a handle (10) to access the fire. For structural reasons a sufficiently rigid material or frame may be desirable so that the top surface (8) may be used in a practical fashion without danger of collapse. The material from which the top surface (8) is made may be the same or may be different from the screen material utilized in the truncated side panel (6). Also shown on FIG. 3 are two side handles (11) which may assist the user in moving the screen, if desired. To hold the device in the assembled position as shown, some means of attaching the two truncated end panels (42) together is desirable. This means may be a detachable ring (43). Other attachment means, such as a hook are also possible. Similarly such a means could be provided to attach the top surface (8) to one or more truncated side panels (6) to add stability.

Figure 4:
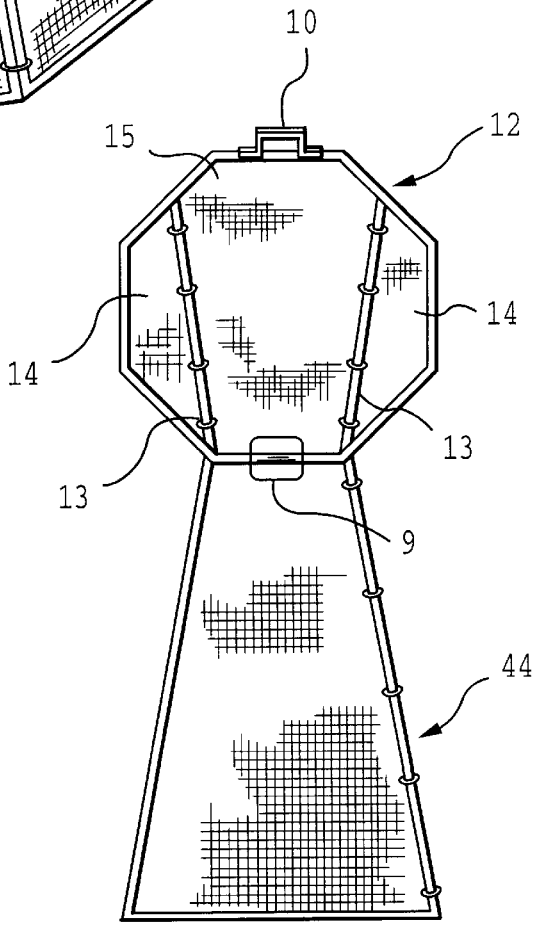
FIG. 4 is a top view of a truncated-pyramid embodiment of the device with the side panels folded and with a foldable top panel.

Referring now to FIG. 4, a top view of the truncated pyramid-shaped device in a partially folded position. Shown are the folded truncated side panels (44) and a foldable top surface (12). Through this embodiment, it is demonstrated that the truncated pyramid-shaped device can also be made so as to be easily transported and compacted. As shown in FIG. 4, this embodiment includes a top hinge (9) joining the foldable top panel (12) to one of the truncated side panels (44). Also, on one end of the foldable top panel (12) is a handle (10). Additionally, a multiple of handles (10) can be attached to diametrically-opposed side panels (44) in the vicinity of the top panel (12). To compact the device, first the attachment means such as the detachable ring (43) is undone. Then the truncated side panels (44) are folded alternatingly left and right, as would be accomplished for the pyramid-shaped device shown in FIG. 1. The top panel is then folded on top of the folded truncated side panels (44). As shown in FIG. 4, the top panel may also include additional folding means (13) to allow the compacted device to present no larger area than necessary. The foldable top panel (12) would be folded over the folded truncated side panels (44) and the two side top panels (14) would then be folded over the central top panel (15).

Figure 5:
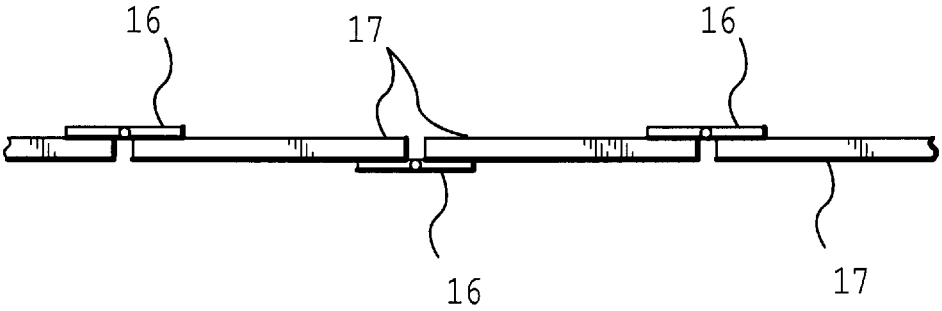
FIG. 5 is a side view of the hinged embodiment showing the alternating hinges.

Referring to FIG. 5, a side view of the hinged embodiment, it can be seen that in the event side hinges (16) are chosen rather than the rings (2) as shown in FIG. 1, the side hinges (16) may be placed on alternating sides of the side panels to allow for flat folding. These side hinges (16) are connected alternatingly on similar faces of adjacent planes. In this fashion, in the event the panels have nontrivial thickness, these alternating hinges (16) will allow for flat folding to the largest degree possible. The utilization of this technique also allows for the provision of a metal frame in the event additional structural rigidity is desired. The metal frame, would surround each of the side panels—whether using the triangular side panels (1) shown in FIG. 1 or the truncated side panels (6) shown in FIG. 3. Attached to the frame and covering the entire inner area of the panels would be the screen material chosen. This would also offer the added advantage that a lighter weight material could perhaps be chosen because it might not have to contribute structurally to the device. The frames (17), shown on their sides in FIG. 5, would then be the load bearing elements.

Figure 6:
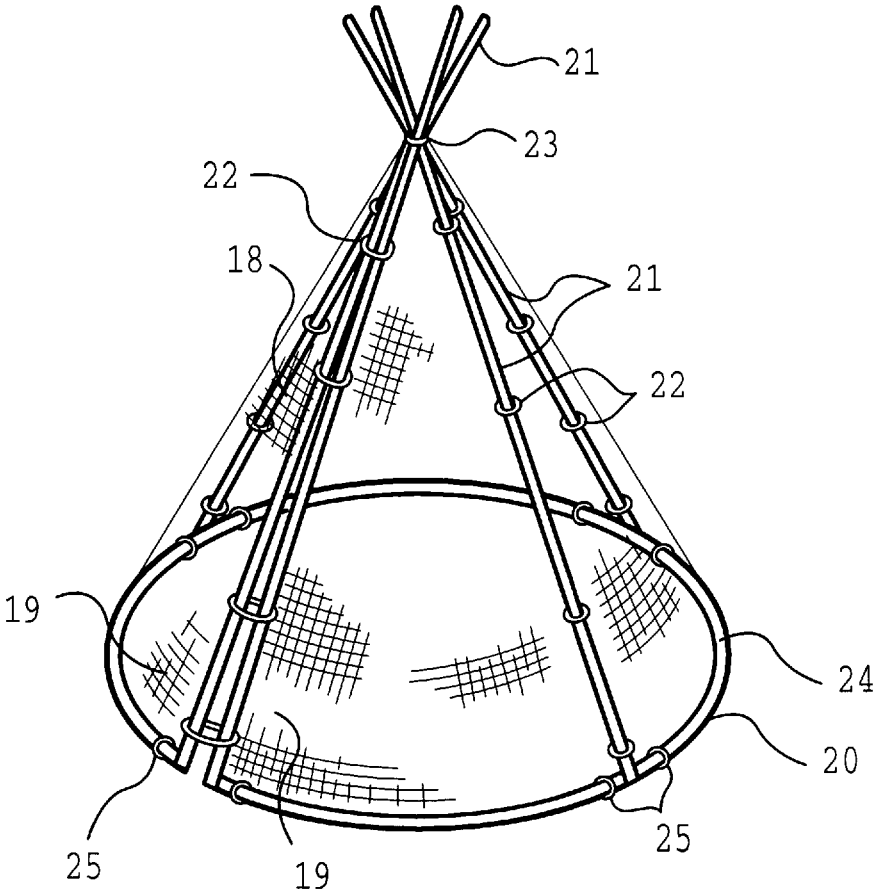
FIG. 6 is a perspective view of the conically-shaped embodiment of the device in the assembled position.

As mentioned earlier, the present invention may take any number of geometrical shapes. As shown in FIG. 6, a conically-shaped device is also possible. In FIG. 6, it should be noted that the screen (18) would be one piece having ends (19). The shape would be such that one piece may be placed so that the base (20) roughly forms a circle and the overall shape conical. Thus, each self-supporting member would form a segmented fragment of a conically shaped surface Structural strength can be added by means of one or more rods (21). The rods (21) may be temporarily attached to the screen by means of rings (22). In this fashion the rods (21) would merely be inserted through the rings (22) by sliding the rods down into the rings (22). The rods may or may not include some means for attaching at the vertex (23). As shown in the vicinity of the two ends (19), the ends (19) may be joined by a means of a single rod (21) and rings (22). In this fashion the rod passes through rings (22) attached to one end (19) and also passes through rings (22) attached to the other end (19). This holds the ends together allowing for the device to retain its shape when in use. To compact this device, the rods (21) are slid out of the rings (22) and the screen (18) is rolled into a compacted position. Naturally, the material chosen for the screen must necessarily have the additional property of being able to be rolled without weakening or bending. Also, the conically-shaped device shown in FIG. 6 could include a base frame (24). This base frame (24) could be made of several circularly shaped members which would then be placed through additional base rings (25). In addition to these features, the conically-shaped device shown in FIG. 6 could also be adapted to include a horizontal top surface as in the truncated pyramid-shaped device. No figure has been included to show this embodiment as it is readily understandable from those already provided.

Figure 7:
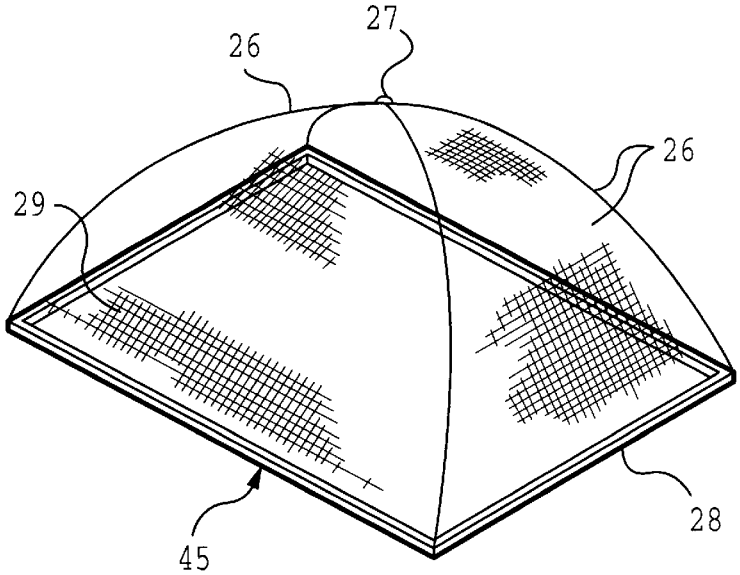
FIG. 7 is a perspective view of a dome-shaped embodiment of the device.

Referring now to FIG. 7, a domed-shaped device, it can be seen that one embodiment could include two or more dome members (26). These dome members (26) could be arch-shaped or semicircular and may be joined in their center section by means of some pivot (27). They could also join to a base member (28) which would have the appropriate polyhedron shape. The screen (29) would then attach to the dome members (26) and the base member (28). Similar to the base (20) shown in FIG. 6, the dome-shaped device may include a square base (45). The dome members (26) would then be attached to the square base (45) at its corners as shown. The dome members, if flexible, could thus be held into position.

Figure 8:
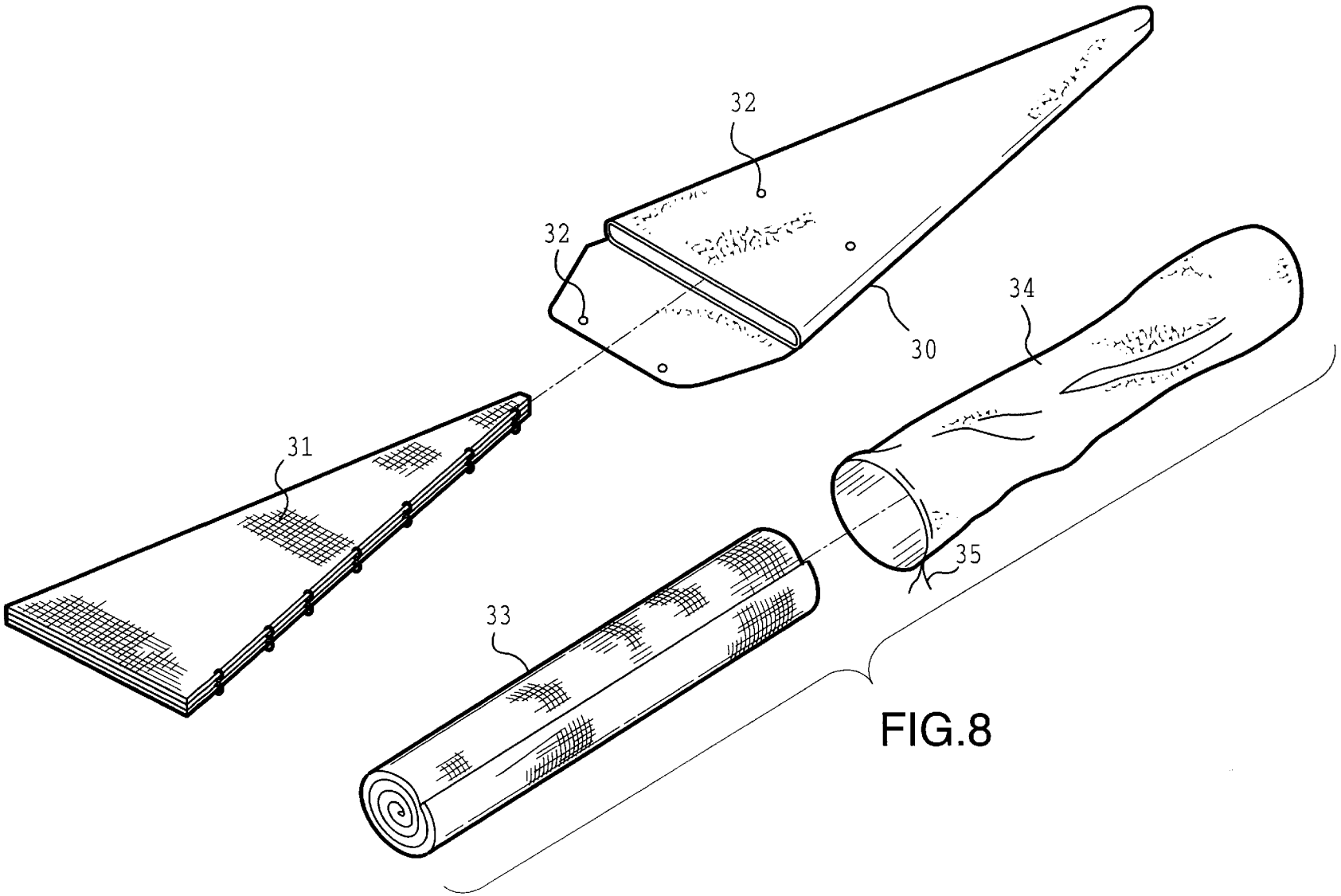
FIG. 8 is an exploded view of the folded device and two types of containers.

As mentioned earlier, any of the devices and embodiments shown may or may not be portable. For those designed to be portable, it would be desirable that the device be easily compacted by either folding or rolling. The panels can be folded in an accordion fashion for portability and transportation. Once compacted, the device could then be placed in some type of container. As shown in FIG. 8, containers could be any appropriate shape. Shown and specifically adapted to use with the folded pyramid-shaped device is a bag (30). This bag (30) could be made of any material such as canvas or nylon. The bag could be lined with a heat resistive or insulative material for protection if the device was inserted while hot. It would thus serve not only to retain the folded device in its compacted state but also to protect other items from contact with the folded device after its use. This would be important because the device would naturally have soot or other materials on its surface. The folded pyramid-shaped device (31) would then be slid into the bag (30) and the top could be closed by some appropriate means such as snaps (32). Shown in FIG. 8 and specifically adapted to a rolled device (33) is a stuff sack (34). This stuff sack again could be made of any appropriate material such as canvas or nylon and would then be slid over the rolled device (33) and closed by means of a drawstring (35). The stuff sack (34) would serve not only to retain the rolled device (33) in its rolled position, but also to protect any other materials from contact with the rolled device.

Regarding methods of assisting in the safety of campfires, one method is to obtain a spark-impregnable, fire-passable material and cut it into triangularly shaped panels. Then the edges and base support of the panels are folded over to make a thickened edge or base for structural stiffness. Holes can be punched or cut through the material. Alternatively, grommets can be inserted in the edges and at the top of the panels. These grommets may pass through the stiffened edges and base. The grommets may also assist in retaining the material in a folded-over condition. A ring or hinge may be inserted through the holes or grommets to fasten multiple panels in sequence. Generally the panels on the end, denoted end panels, will not be joined so that they can be folded out of the way when servicing the fire or otherwise reaching the fire. A vertex ember restrictor can be attached to the upper end of the panels. To assist in the restrictor staying in position, it may be desirable to attach it in at least one place and preferably two places at the upper end. The device can be folded into a compact assembly and transported to a suitable place for a campfire. After locating a suitable place, it generally is advisable to remove the undesirable combustible debris before establishing a campfire. Either after or before the campfire is established, the device is unfolded and arranged in a fashion to surround the campfire. Typically this would approximate a circle but could be a polygonal shape. One method of surrounding the campfire is to grasp the panels, preferably on each end of the assembly at the end panels, and spread out device like a large hand fan. Then, place a middle point of the bottom of the device on the other side of the campfire on the ground or structure and successively fold the remaining panels around the campfire to form the circle around the campfire. Generally, the device will surround the campfire in a substantially central manner where the vertical center of the assembled device will approximate the vertical center of the campfire.

If the campfire is to be made on ground having sod or thick grass or even over undesirable combustible debris, it may be preferable to dig the sod or grass out to a depth of generally 4–5 inches so that mainly dirt is exposed to the fire (although less or more may be appropriate for the given circumstances). To assist in determining the circumference to dig, the device can be assembled on the ground and a stick or other suitable marking instrument can scratch and thus inscribe the surface of the ground about the inside or outside perimeter of the assembled device. The device can be temporarily removed and the sod or grass or undesirable combustible debris removed from that area surrounded by the circumference and set aside for future use. The use of the term "circumference" is not restricted the perimeter of a circle but can include any shape surrounding a suitable area for preparation and placement of a campfire that will be surrounded by the device herein described. As a further step to insure safety, once the device is assembled in position, an earthen dam around the bottom support of the device can be made. This dam may assist in stabilizing the device and may seal any openings caused by uneven surfaces supporting the device. Later, when the campfire is extinguished, the device can be folded back into a portable condition. Also, it may be stored in a cover or carrying case for ease of transportation.

When setting up the device, it may appreciated that irregularly shaped ground may be encountered. To accommodate this aspect, the device may include some system to conform to the irregular surface. This may be accomplished by designing the self-supporting members to have an element which permits conforming, such as a flexible base supporting areas or may be accomplished through some separate element. In one design this may also be done by designing the hinge elements appropriately. This may be as simple as including some type of transversely movable elements such as oversized rings and the like. While naturally, it would be expected that no additional space between the self-supporting members is desirable, this aspect is—perhaps surprisingly—directed away from this approach. Instead of having the tightest fit (to minimize the risk of embers passing between adjacent surfaces), the oversize rings might have some additional diameter so as to create additional space between such members. In this fashion, the oversize rings would permit two adjacent members to move with respect to each other and thus conform more closely to an irregular surface.

Figure 9:
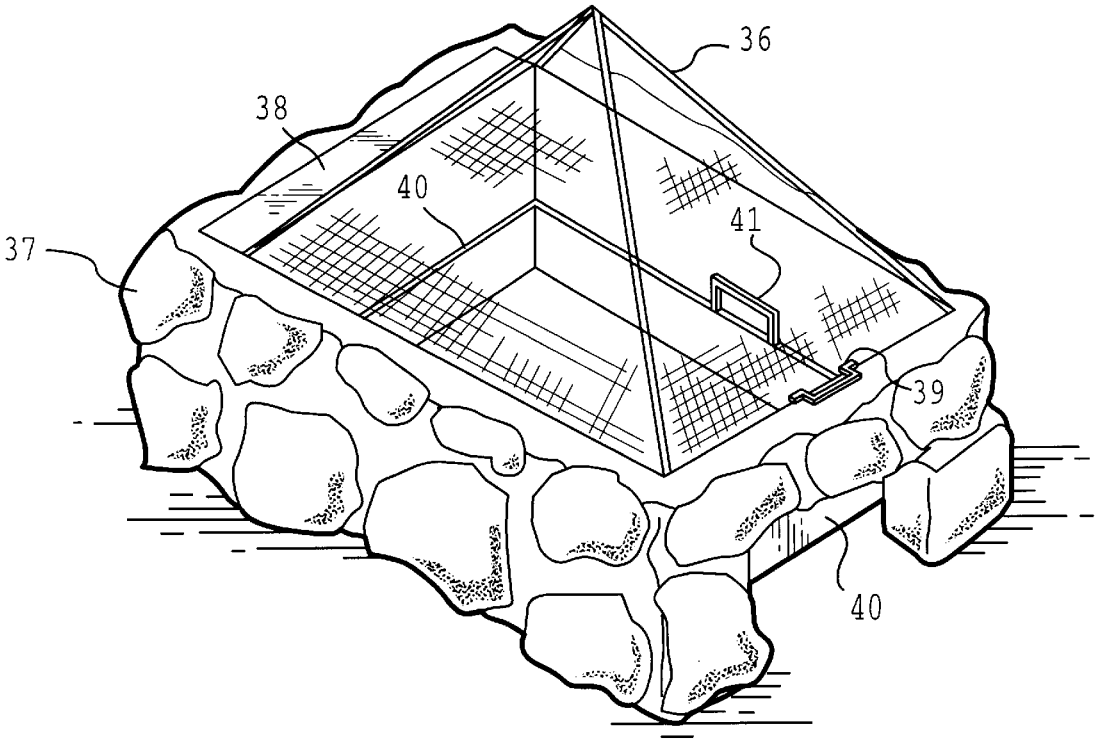
FIG. 9 is a perspective view of the permanently mounted device in place on a stone base.

Several embodiments are shown which are not designed to be portable. In instances in which permanent installations are desired—such as national forest campgrounds and the like—the device could be specifically adapted to permanent use. Referring now to FIG. 9, the device shows a four-sided pyramid-shaped device (36). This device is attached to a stone base (37) by some folding means such as a base hinge (38). This base hinge would then be attached to the stone base (37) in some permanent fashion so that the pyramid-shaped device (36) could not be removed from the base (37). Also included is a handle (39) to allow lifting of the pyramid-shaped device (36) for access to the fire. Within the stone base (37) is shown a tray (40) which may include access handles (41). This tray would serve to allow easy removal of ashes or cleaning of the fire after use. As can be appreciated the stone base (37) may or may not be designed as shown to include a front access area (41). In permanent installations, the pyramid-shaped device (36) could include a much heavier frame and much heavier screen material to add to durability. Naturally the stone base (37) could be made of other materials such as bricks, concrete block or any other sufficiently permanent and rugged product. As can be readily appreciated for the truncated pyramid device shown in FIG. 3, the dome device shown in FIG. 7, and even the conically-shaped device shown in FIG. 6, almost any of the embodiments shown can be adapted for permanent installation. In FIG. 9, however, only the pyramid-shaped device (36) has been shown. This is not meant to present any limitation or other restriction on applicability of the embodiments presented. While application to permanent emplacements may present a larger commercial application, it is believed that from the perspective of the central purpose of enhancing the safety of campfires and preventing forest fires, the portability of a device such as that shown in FIG. 1 is a very important aspect.

It is believed that by presenting a device that is sufficiently easy to use and easy to transport, those persons utilizing campfires in remote areas will be inclined to use this device in areas having unusual susceptibility to forest fires. Recreational users would be able to transport the device by placing the device in or on a backpack. It could also become a requirement for remote campfires—at least during times of high fire danger. In permanent uses, the device could also me adapted for use in tepees or yurts without substantial modification. As a side benefit, the device would not only present an additional safety aspect, but it would also help shield the fire from wind. This may be desirable from the user's perspective in addition to enhancing the safety of the campfire during windy times.

The foregoing discussion and the claims which follow describe preferred embodiments of the present invention. Particularly with respect to the claims it should be understood that changes may be made without departing from their essence. In this regard, modifications and changes falling within the scope of this patent are not limited by the disclosure. All modifications and changes known to those skilled in the art to achieve the desires of this invention and others which use substantially the same means in substantially the same way to achieve substantially the same result are intended to fall within the scope of this patent. It simply is not practical to describe and claim all possible revisions to the present invention which may be accomplished. To the extent, each fall within the breadth of protection encompassed by this patent. This is particularly true for the present invention since its basic concepts and understandings are fundamental in nature and can be broadly applied.

I claim:

1. A device for preventing the unintentional spread of a campfire comprising:

a. at least five triangularly shaped self-supporting members wherein said self-supporting members are configured when surrounding said campfire to substantially point to a vertex at an upper end of said self-supporting members and further comprising an overlapping vertex ember restrictor overlapping said self-supporting members at said upper end when surrounding said campfire and wherein said overlapping vertex ember restrictor is generally diametrically hingeably attached to generally diametrically opposed self-supporting members at said upper end of said self-supporting members;

b. a spark-impregnable, fire-passable material located on said self-supporting members;

c. a plurality of hinge elements joining said self-supporting members to allow repeated folding and unfolding of said members;

d. a base support on each self-supporting member; and f. at least two side edges on each self-supporting member wherein said base supports of said self-supporting members have a cumulative base length sufficient so as to substantially surround said campfire and wherein said device has a weight so as to allow manual transportation of said device.

2. A device for preventing the unintentional spread of a campfire as described in claim 1 wherein said base supports of said self-supporting members that are assembled to surround said campfire have a center point and wherein each said base support substantially defines an angle $\alpha$ from said center point equal to the result in degrees of the formula 360 degrees divided by n, where n is the number of said self-supporting members.

3. A device for preventing the unintentional spread of a campfire as described in claim 2 wherein each said triangularly shaped self-supporting member comprises a segmented fragment of a conically shaped surface.

4. A device for preventing the unintentional spread of a campfire as described in claim 3 wherein said hinge elements comprise rings.

5. A device for preventing the unintentional spread of a campfire as described in claim 4 wherein said side edges have a plurality of ring hinge receptors through which said side edges are joined by said rings.

6. A device for preventing the unintentional spread of a campfire as described in claim 5 wherein said ring hinge receptors comprise grommets.

7. A device for preventing the unintentional spread of a campfire as described in claim 1 wherein said self-supporting members comprise substantially planar panels.

8. A device for preventing the unintentional spread of a campfire as described in claim 7 wherein two of said five self-supporting members are end panels.

9. A device for preventing the unintentional spread of a campfire as described in claim 1 wherein said device does not weigh substantially more than 10 pounds.

10. A device for preventing the unintentional spread of a campfire as described in claim 1 wherein said spark-impregnable, fire-passable material is a mesh size of 24—24 mesh, 0.020 diameter wire.

11. A device for preventing the unintentional spread of a campfire as described in claim 1 wherein said spark-impregnable, fire-passable material comprises stainless steel.

12. A device for preventing the unintentional spread of a campfire as described in claim 1 wherein said self-supporting members and said spark-impregnable, fire-passable material are integral.

13. A device for preventing the unintentional spread of a campfire as described in claim 12 wherein said spark-impregnable, fire-passable material has a thickness layer and wherein each said side edge is folded over to form at least two thickness layers.

14. A device for preventing the unintentional spread of a campfire as described in claim 1 wherein said hinge elements comprise rings.

15. A device for preventing the unintentional spread of a campfire as described in claim 14 wherein said side edges have a plurality of ring hinge receptors through which said side edges are joined by said rings.

16. A device for preventing the unintentional spread of a campfire as described in claim 15 wherein said ring hinge receptors comprise grommets.

17. A device for preventing the unintentional spread of a campfire as described in claim 1 wherein said hinge elements comprise hinges.

18. A device for preventing the unintentional spread of a campfire as described in claim 1 wherein said self-supporting members comprise at least one element which permits conforming to an irregular supporting surface around said campfire.

19. A device for preventing the unintentional spread of a campfire as described in claim 1 wherein said hinge elements comprise tranversly movable conforming elements.

20. A device for preventing the unintentional spread of a campfire as described in claim 19 wherein said tranversly movable conforming elements comprise oversize rings having sufficient diameter to create additional space between said self supporting members.

21. A device for preventing the unintentional spread of a campfire comprising:

a. at least three triangularly shaped self-supporting members wherein said self-supporting members are configured when surrounding said campfire to substantially point to a vertex at an upper end of said self-supporting members;

b. a spark-impregnable, fire-passable material located on said self-supporting members;

c. a plurality of hinge elements joining said self-supporting members to allow repeated folding and unfolding of said members;

d. a base support on each self-supporting member wherein said base supports of said self-supporting members have a cumulative base length sufficient so as to substantially surround said campfire;

f. at least two side edges on each self-supporting member; and g. an overlapping vertex ember restrictor overlapping said self-supporting members at said upper end when surrounding said campfire and wherein said overlapping vertex ember restrictor is generally diametrically hingeably attached to generally diametrically opposed self-supporting members at said upper end of said self-supporting members;

and wherein said device has a weight so as to allow manual transportation of said device.

22. A method to keep a campfire from spreading comprising the steps of:

a. obtaining a spark-impregnable, fire-passable material;

b. cutting said material into triangularly shaped members having a base support and at least two side edges and an upper end;

c. folding said material at least once over at said base support and side edges;

d. hingeably attaching said triangularly shaped members in a configuration to surround said campfire so that said members substantially point to a vertex at said upper end;

e. hingeably attaching an overlapping vertex ember restrictor at substantially diametrical points across said upper end of self-supporting members;

f. folding into an assembly said self-supporting members;

g. locating a suitable place for said campfire;

h. removing undesirable combustible debris;

i. establishing said campfire;

j. unfolding said triangularly shaped members; and k. positioning said campfire spreading prevention device around the campfire so that it substantially completely surrounds said campfire.

23. A method to keep a campfire from spreading as described in claim 22 and further comprising the step of inserting ring hinge receptors at said side edges and said upper end.

24. A method to keep a campfire from spreading as described in claim 23 and further comprising the step of embanking an earthen dam around said base support.

25. A method to keep a campfire from spreading as described in claim 22 and further comprising the step of embanking an earthen dam around said base support.

26. A method to keep a campfire from spreading as described in claim 22 and further comprising the step of allowing said device to be partially folded back to allow access to said campfire.

27. A method to keep a campfire from spreading as described in claim 26 and further comprising the step of folding said triangularly shaped members.

28. A method to keep a campfire from spreading as described in claim 27 and further comprising the step of inserting said triangularly shaped members into a cover for storage and transportation.

* * * * *